United States Patent [19]

Staub et al.

[11] 4,264,389

[45] Apr. 28, 1981

[54] METHOD OF MANUFACTURING A TENNIS RACKET

[75] Inventors: Anthony F. Staub; Norman T. Staub, both of Dayton, Ohio; John R. Erwin, Paradise Valley, Ariz.

[73] Assignee: Starwin Industries, Inc., Dayton, Ohio

[21] Appl. No.: 112,380

[22] Filed: Jan. 15, 1980

Related U.S. Application Data

[60] Continuation-in-part of Ser. No. 827,670, Aug. 25, 1977, Pat. No. 4,183,776, which is a division of Ser. No. 480,462, Jun. 18, 1974, Pat. No. 4,045,025, which is a continuation-in-part of Ser. No. 332,130, Feb. 13, 1973, abandoned, which is a division of Ser. No. 107,304, Jan. 18, 1971, Pat. No. 3,755,037.

[51] Int. Cl.[3] ..... B65H 81/00; A63B 49/10

[52] U.S. Cl. ..... 156/156; 156/245; 156/253; 264/258; 264/304; 273/73 F

[58] Field of Search ..... 156/156, 171, 172, 173, 156/188, 189, 191, 245, 253, 252; 264/137, 258, 313, 314; 273/73 F, 73 D, DIG. 7

[56] References Cited

U.S. PATENT DOCUMENTS

| | | | |
|---|---|---|---|
| 3,483,055 | 12/1969 | Eshbaugh | 156/189 |
| 3,755,037 | 8/1973 | Erwin et al. | 264/314 |
| 3,930,920 | 1/1976 | Kicheren | 156/156 |
| 3,993,308 | 11/1976 | Jenks | 273/73 F |
| 4,128,963 | 12/1978 | Dano | 156/245 |
| 4,183,776 | 1/1980 | Staub et al. | 156/156 |

*Primary Examiner*—Michael W. Ball

*Attorney, Agent, or Firm*—Biebel, French & Nauman

[57] ABSTRACT

A tennis racket frame is constructed primarily of an elongated tubular member having a wall thereof consisting of a plurality of concentric layers of high tensile strength fibers impregnated and bonded together by binder resin to produce a hollow cored tennis racket. The method includes forming a plurality of string holes in the head portion of the racket, during or prior to the molding operation. The holes are formed by separating the fibers around the location of the hole by passing pointed penetrating tools through the frame in the area which will form the head portion thereof, and either retaining the tool in position in the holes during molding, or replacing the tools with positioning pins or grommets prior to the molding operation. If the pins are utilized they may be removed after molding of the racket is complete, and if grommets are utilized they become integrally attached to the racket and provide additional support for the strings.

9 Claims, 20 Drawing Figures

84
86
88
90
92
82
94
80
83
72
104
102
100
98
96
75

112380

84
86
88
90
140
142
144
82
94
130
138
134
132
135

82
82
20
134
138
132
130

152
156
10

156
156
152
156
154
156
156

146
56
150
148

METHOD OF MANUFACTURING A TENNIS RACKET

CROSS REFERENCE TO CORRESPONDING APPLICATIONS

This application is a continuation-in-part of application Ser. No. 827,670, filed Aug. 25, 1977 now U.S. Pat. No. 4,183,776 as a division of application Ser. No. 480,462, filed June 18, 1974 now U.S. Pat. No. 4,045,025, which in turn is a continuation-in-part of application Ser. No. 332,130, filed Feb. 13, 1973 now abandoned as a division of application Ser. No. 107,304, filed Jan. 18, 1971 which is now U.S. Pat. No. 3,755,037.

BACKGROUND OF THE INVENTION

Field of the Invention

This invention relates to the manufacture of rackets, and particularly tennis rackets although the principles thereof are applicable to any type of strung racquet, e.g. squash rackets, racketball rackets, and the like.

In recent years a substantial trend has developed towards the use of racket frames made of fiber reenforced resin or metal as opposed to the long standing use of rackets made of wood. Both metal and fiber reenforced resin rackets possess certain advantages over wooden rackets, for example, in that they are less subject to warping and fatigue. However, the metal rackets present further problems in that the equipment required to form such rackets is relatively expensive, they are subject to cracking wherever any welds are used in the racket, and the physical properties of density, strength and stiffness tend to result in a racket which is not sufficiently flexible and is difficult to obtain proper playing qualities.

The fiber reenforced resin rackets have a very high tensile strength, a good modulus of elasticity, the materials are relatively inexpensive, and they can be readily formed and otherwise handled. There are generally two ways of forming fiber reenforced resin rackets. The first is through utilization of a solid core about which a series of preimpregnated fiber strips are wound in a plurality of layers and then placed in a mold for curing so that the core and the layers of reenforced resin become essentially integral. Such a method is disclosed, for example, in U.S. Pat. No. 4,128,963. A second method of forming reenforced resin rackets is by utilization of a removable core about which the series of reenforced strips of impregnated fiber are wound and then molded, with the core being removed after the racket has hardened in its final form. Such a method is disclosed, for example, in the above referred to application Ser. No. 827,670.

The years of playing with these types of fiber reenforced resin rackets have indicated some problems in the area of formation of the holes for the strings in the head portion of the racket in that the rackets tend to be weaker in the areas where the holes are formed, and have shown tendencies to crack or break through these holes. In addition, the constant movement of the strings within these holes has resulted in a wearing away of the resinous material which results in the fairly strong fibers cutting through the strings and causing a continually increasing breakage of the strings as the racket continues to wear. Both of these problems are the result of the manner in which the holes are formed in the rackets.

In the past it has been common to form such holes by drilling after the racket has been completely formed and molded. This necessitates drilling through the fiber reenforcing as well as the resin which obviously tends to decrease the strength of the racket in the area of the holes that have been drilled, and also presents a plurality of frayed ends of the reenforcing fibers where they have been cut through which then, as the resin is worn away through use, tend to cut through the strings causing increasing breakage thereof.

SUMMARY OF THE INVENTION

The present invention overcomes the above described difficulties and disadvantages associated with such prior art methods of forming rackets by providing a method in which the holes are formed in the racket during the molding operation by separation of the fibers rather than cutting through them. Although such a procedure has been generally suggested in the prior art for fiber reenforced resin rackets which include a solid core, there has been no practical method of achieving this advantage in those rackets having a hollow core, since until the racket is completely formed it does not possess sufficient structural rigidity on its own to permit the formation of holes before the molding operation is complete.

In the present invention, which is particularly directed to the formation of holes in rackets having a hollow core, several methods have been developed for accomplishing this desirable feat. The method is based, in part, on the techniques disclosed in the above referred to application Ser. No. 827,670 and its predecessors, in which a removable, inflatable tubing is utilized as the core member during molding to support a plurality of layers of fiber reenforced resin and other layers of material used to form a tubular member which becomes the frame of the racket. A plurality of penetrating tools extending in from each side of the frame are then used to pierce the plurality of layers of material in the head portion while separating the fibers in the reenforced resin when it is in the unhardened, semi-liquid state. In this method care must be taken not to permit the penetrating tools to extend too deeply into the frame or they will pierce the tubular support.

A modification in accordance with the present invention, of the method of producing the frame structure for the tennis racket as disclosed in the above referred application Ser. No. 827,670, is in the substitution of a tube looped to form two parallel runs in place of the single run of tube utilized to act as the support for the tubular member which will form the frame. The diameter of the tube utilized in the present method is sufficiently small to permit two runs of the tube to be put through the hollow central core region of the tubular member in adjacent, overlying relation so that the external dimensions of the frame are maintained the same as in the previous method of application Ser. No. 827,670.

In a first variation of the method of the present invention the tubular member formed of multiple layers of wrapping of fiber reenforced resin material is formed about a core support member which is removed from the inside of the tubular member once it is formed. The looped tubing, referred to above, with its two parallel runs is then inserted in the tubular member with the looped region extending beyond one end of the tubular member and the open ends of the tubing extending beyond the other end. The tubular member is then placed in a curing mold which has a cavity the shape of a racket frame and is generally the same as the mold disclosed in application Ser. No. 827,670. However, in this mold, a plurality of holes extend through the mold from the outside surface, through the mold cavity and into the interior of the mold, extending radially inward around the head portion of the mold cavity at proper locations for forming string holes therein. Supported on a frame structure surrounding the mold are a plurality of pointed penetrating tools; each aligned with the corresponding hole through the mold.

After the tubular member has been placed in the mold cavity, the mold is closed and pressure is applied to the tubing in the tubular member to maintain the external shape of the tubular member during the molding operation. After the curing mold has heated the tubular member sufficiently to soften the resin, the penetrating tools are passed through the holes in the mold and into the tubular member where they form the string holes as they pass through. The tools are forced through the tubular member by a steady or cyclical pressure along the axis of the tool, but are preferably rotated and advanced through the tubular member simultaneously to assist in parting the fibers in the resin layer. The holes in the mold are positioned relative to the cavity so that the penetrating tools will pass between the two runs of tubing supporting the tubular member.

After the tubular member has been in the curing mold a sufficient time for the racket frame to become completely cured, the penetrating tools are retracted from the mold, the mold opened, pressure is relieved in the tubing, the racket removed and the tubing removed from the finished racket frame.

A second variation of the method of the present invention involves utilizing essentially the same technique discussed above for forcing the penetrating tools through the frame structure, but this is accomplished in a separate mold which supports the tubular member in a straight line within the mold. The mold cavity will maintain a generally rectangular outline of the tubular member. The same looped tubing is inserted in the hollow central core of the tubular member and is inflated to hold the form of the tubular member with its outer surfaces in contact with the mold cavity surfaces. A plurality of heated penetrated tools are then passed through corresponding holes in the mold and through the tubular member at locations where the tools will pass between the parallel runs of tubing at positions for forming string holes. The penetrating tools are pointed and can be forced through the tubular member as heat from the tools softens the resin in the area of each tool.

After formation of the holes in this manner, the penetrating tools are removed and pins of the same diameter as the holes and longer than the width of the tubular member are inserted in the string holes through the holes in the mold. The pressure in the tubing is then relieved, the mold opened and the straight tubular member with the pins in the string holes is removed.

The curing mold is provided with holes which are split on the diameter by the part line of the mold and positioned at proper locations around the head portion of the racket forming cavity so as to properly locate the pins in the tubular member during curing. Otherwise, the curing mold is essentially the same as that described above, and as that disclosed in application Ser. No. 827,670.

With the tubular member placed in the curing mold cavity and the pins positioned in their respective holes in the mold, pressure is again applied to the tubing to maintain the shape of the racket during curing. After the racket is cured pressure is relieved in the tubing, the mold is opened, the racket is removed from the mold and then the pins and tubing are removed from the racket.

In either of the above two alternative variations of the method of the present invention it can be further advantageous to provide a flexible plastic covering over the runs of tubing with the covering sealed between the runs in order to present a space therebetween which can aid in maintaining a separation between the runs through which the penetrating tools can be passed. In addition, the penetrating tools are preferably bullet-shaped, blending into a straight cylindrical shank of the appropriate diameter for the holes.

Further, the means for driving the penetrating tools in either of the above referred to variations on the method of the present invention can take a variety of forms. Where low production rate is acceptable, the penetrating tools may be hand driven such as by merely rotating them by hand while applying axial pressure to force them through the frame structure, or impacting them so that they are driven through the frame structure. In the preferred form, however, the drive means preferably comprises a reversible motor, which can be electric, hydraulic or pneumatic, and which is mounted adjacent the mold for axial movement along with each penetrating tool toward and away from the mold.

Each of the motors for each penetrating tool is separately mounted in a slide frame and has its drive shaft connected to a threaded member to which a penetrating tool is secured, and which threaded member is supported in a stationary, correspondingly threaded block which causes the penetrating tool to move in and out of the mold, depending upon the direction of rotation of the motor drive shaft. A further variation of the drive means is contemplated by providing a gang-type drive arrangement where a plurality of the penetrating tools are driven by a single motor through a gearing arrangement, but which otherwise operates in the same manner through a plurality of threaded members and associated support blocks.

DETAILED DESCRIPTION OF THE PREFERRED METHODS

Figure 1:
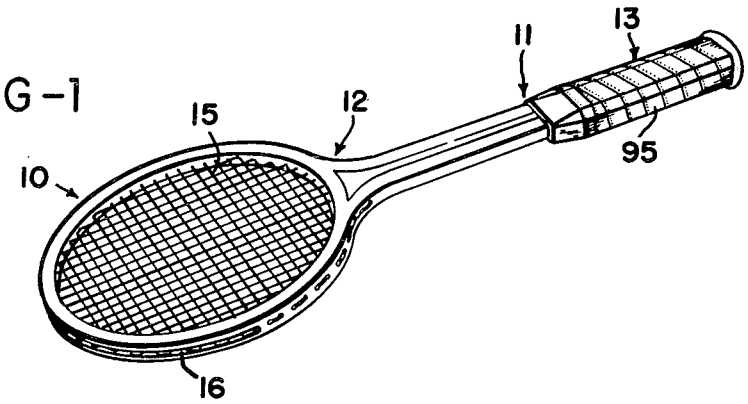
FIG. 1 is a a perspective view showing a complete racket of the type formed in accordance with the present invention.

FIG. 1 shows a complete tennis racket in accordance with the invention in which the frame includes a generally oval shaped head portion 10, a handle portion 11, and a throat portion 12 interconnecting the head and handle portions. The handle 11 is provided with a grip 13, and the head 10 carries the strings 15. The head 10 is formed with a groove 16 extending around at least the outer end half of its periphery, although it could extend through the entire strung area of the head portion 10, and the loop portions 15 of the strings are recessed in this groove below the adjacent peripheral portions of the frame, for protection in use.

Figure 5:
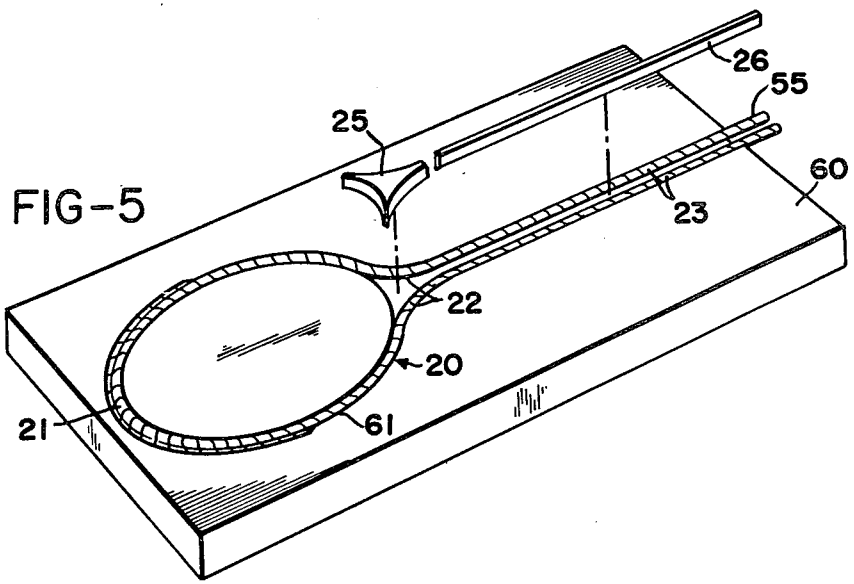
FIG. 5 is a partially exploded isometric view illustrating the preformed mold in the corresponding stage in the fabrication of the racket frame.
Figure 3:
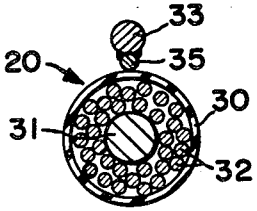
FIG. 3 is an enlarged section on line 3—3 of FIG. 2.

The basic structural part of this racket frame is the unitary tubular member 20, which includes the loop 21 defining the head 10, the converging sections 22 defining the throat 12, and the parallel end sections 23 defining the handle 11. The only other pieces of the frame, with the exception of the grip 13, are a filler piece 25 between the throat portions 22, and a fin-like spreader member 26 extending between the handle sections 23 (both shown in FIG. 5), both of which are optional and are made of light material such as balsa wood or plastic foam.

Initial construction of the racket is basically in accordance with the teachings of the above referred to application Ser. No. 827,670 and forms no part of the present invention except to provide one form of racket in which the method of the present invention may be utilized. It is to be understood, however, that with the exception of the provision of a hollow core and means for providing a passageway for the penetrating tools, as described below, the construction of the racket is otherwise not limited to the following description of the basic formation of the racket frame.

The first stage in formaion of a racket frame is the formation of a mandrel comprising an elastomeric tube 30, core wires 31 and 32, and a filler member 33.

It is possible to use only a plurality of wires 32 of small diameter, e.g. 1/16 inch, but it is quicker and easier to use also at least one wire or rod 31 of substantially larger diameter, e.g. 1/4 inch and the rod 31 is shown as provided at one end with a drive collar 36. A sufficient number of the wires 32 is used fo fill the tube 30 completely, and preferably to expand it slightly, for example to an outer diameter of $\frac{3}{8}$ inch.

The purpose of the filler member 33 is to increase the peripheral dimension of the mandrel along its portion corresponding to the part of the head in which the groove 16 is formed. The member 33 can be placed within the tube 30, but it is simpler to locate it on the outside, and this is easily done by welding a section of quarter-inch rod 33 to the middle of a carrier wire 35 of the same length as the other wires 31–32. For a full size frame, the filler member 33 may be 21 inches long. One end of the wire 35 fits in a groove in the collar 36 and is held in place by an O-ring 37. The other end is similarly held on tube 30 by a similar O-ring 37.

Figure 2:
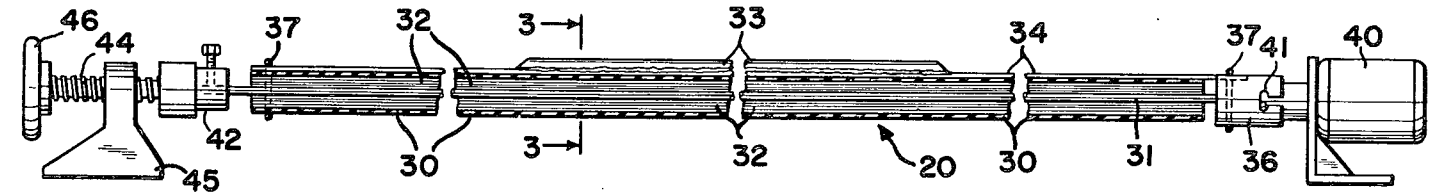
FIG. 2 is a fragmentary view, partially in side elevation and partially in vertical elevation, illustrating a preliminary stage in the fabrication of the racket of FIG. 1.
Figure 4:
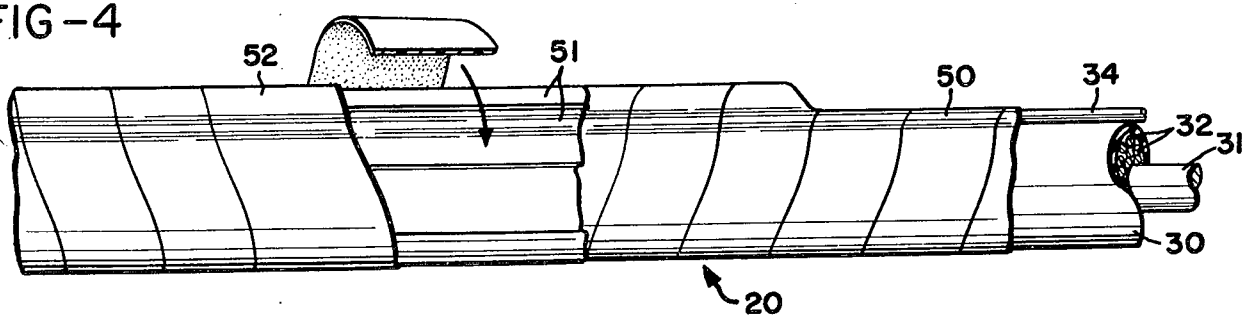
FIG. 4 is a further enlarged fragmentary view illustrating an intermediate stage in the fabrication of the tubular member, or mandrel, which is the main structural part of the racket of FIG. 1.

The completed mandrel is then mounted in a tensioning and winding apparatus as shown in FIG. 2. The shaft of a low speed drive motor 40 holds and drives the collar 36 through a pin and bayonet slot connection 41. The other end of the rod 31 is secured in a chuck 42 mounted for free rotation on an adjustable tail stock comprising a screw 44 threaded in a stand 45 and having a handle 46. Backing off of the screw 44 will provide the necessary tensioning of rod 31 to support the entire mandrel in essentially straight position.

The multiple layers of binder-impregnated fiber are then successively applied to the mandrel, which is easily done while it is being rotated by the motor 40. To some extent, the number and sequence of application of these layers may be varied, but it is important that the majority of the layers be helically wound of unidirectional hand with successive such layers being of opposite hand, and also that there be at least one layer wherein the fibers run lengthwise of the mandrel and which are not twisted.

It is particularly important, for optimum results from the standpoint of both proper control of weight and the proper combination of strength and resiliency in the finished racket, to use tape composed of essentially continuous parallel filaments, as distinguished from woven or braided tape or tubing. One reason for this is that in a woven (mesh) tape, the cross fibers add thickness, since the thickness of the tape doubles at each crossover, forming voids which become filled with resin, adding weight without comparable contribution to strength for the purposes of the invention. In fact, the cross fibers would add no significant strength to the frame as compared with continuous filament tape, but they would double the weight and effectively double the thickness of the wall of tublular member 20 for the same number of tape layers.

Another aspect of this matter is that in a fiber mat structure, wherein relatively short fibers are held together by resin binder, load transfers are required to take place through the resin securing adjacent fibers together, and this is an inefficient use of the tensile strength of the fibers. This same efficiency would be present in helically wound mesh tape, in that the cross fibers would be relatively short, and would have to depend on the resin to transfer loads therebetween. In contrast, with unidirectional continuous filament tape wound helically and with adjacent layers of opposite hand, the continuous filaments provide the most efficient transfer of loads throughout the frame, and their ability in this respect is increased when they are placed in tension in accordance with the practice as described hereinafter.

In a typical example, preferred results have been obtained by applying the following layers of binder-impregnated fiber tape one inch wide in the specified sequence:

A helical layer 50 extending slightly in excess of the full length desired for the tubular member 20, e.g. 63 inches.

A straight full length layer 51 composed of two lengths of the tape.

A second full length helical layer 52 of the opposite hand from layer 50.

Two helical layers of alternatively opposite hand extending over only the central portion corresponding to the loop 21 and converging portions 22, e.g. 32 inches.

A full length helical layer 55 of the opposite hand from the adjacent underlayer. Optionally, particularly for a heavier racket frame, two helical wraps of opposite hand may be applied before the layer 55 along the central portion of the assembly overlying the filler member 33.

As soon as winding has been completed, the assembly is removed from the winding and tensioning apparatus, and the tube 30 and the core wires 31 and 32 are removed from within the tube 30. The filler member 33 and its carrier wire 35 are then also easily removed.

Figure 7:
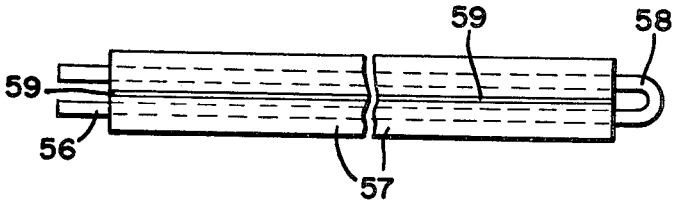
FIG. 7 is a plan view of the looped tubing with a plastic sheath over the tubing which is heat sealed between the runs of tubing.
Figure 8:
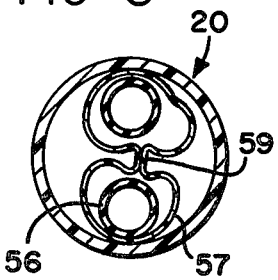
FIG. 8 is a cross sectional view through the tubular member with the tubing and sheathing in place inside.
Figure 20:
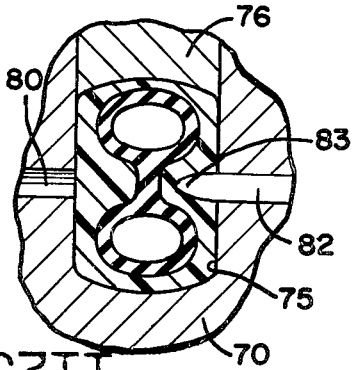
FIG. 20 is a cross sectional view through the head porition of the frame of a racket showing a single extruded tube with a solid central section and two air passages.

At this point, a new elastomeric tube 56 surrounded by a plastic sheathing 57 is inserted in the tubular member 20. As shown in FIG. 7, the tube 56 is doubled over to form a loop 58 with two parallel runs of the tube which is then placed in the sheathing 57. Sheathing 57 is then heat sealed at the center 59, along its length to form separate sheathings about the overlying runs of the tube 56. This assembly is then placed in the tubular member 20 and positioned as shown in FIG. 8 so that one run of the tube 56 overlies the other and are separated by the heat sealed portion 59 of the sheathing 57. The sheathing 57 with the heat sealed portion 59 maintains the two runs of the tube 56 in vertically spaced relation, which is important in the molding process. It is to be understood that although the vertical separation of the two runs of tube 56 is important, it can be accomplished in other ways than by using the sheath 57, although this is the preferred method of doing so. For example, a single extruded tube, as shown in FIG. 20, having a solid central region and two air passages can be utilized.

Referring again to formation of the tubular member 20, it is quicker and simpler to utilize fiber tape already impregnated with binder than to add binder resin in the mold cavity during the final molding stage, and this is particularly true for continuous filament tape because the resin holds the non-woven filaments together. The pre-impregnated tape yields more uniform products, but it tends to be sticky at room temperature, and subsequent handling is facilitated if the tubular member 20 is refrigerated after the core wires have been removed.

In the first preferred alternative of the present invention discussed below, the tubular member 20 along with tube 56 and sheathing 57 are preferably placed in a preform mold 60 having a cavity 61 closely corresponding to the mold cavity in which final curing of the frame is performed. It is also desirable at this stage in the process of the first alternative method, to insert a generally triangular filler member 25 in the open throat area between the converging portions 22 of the tubular member, as well as the divider strip 26 between the handle portions 23. The mold 60 is then refrigerated until the tubular member is needed.

Figure 6:
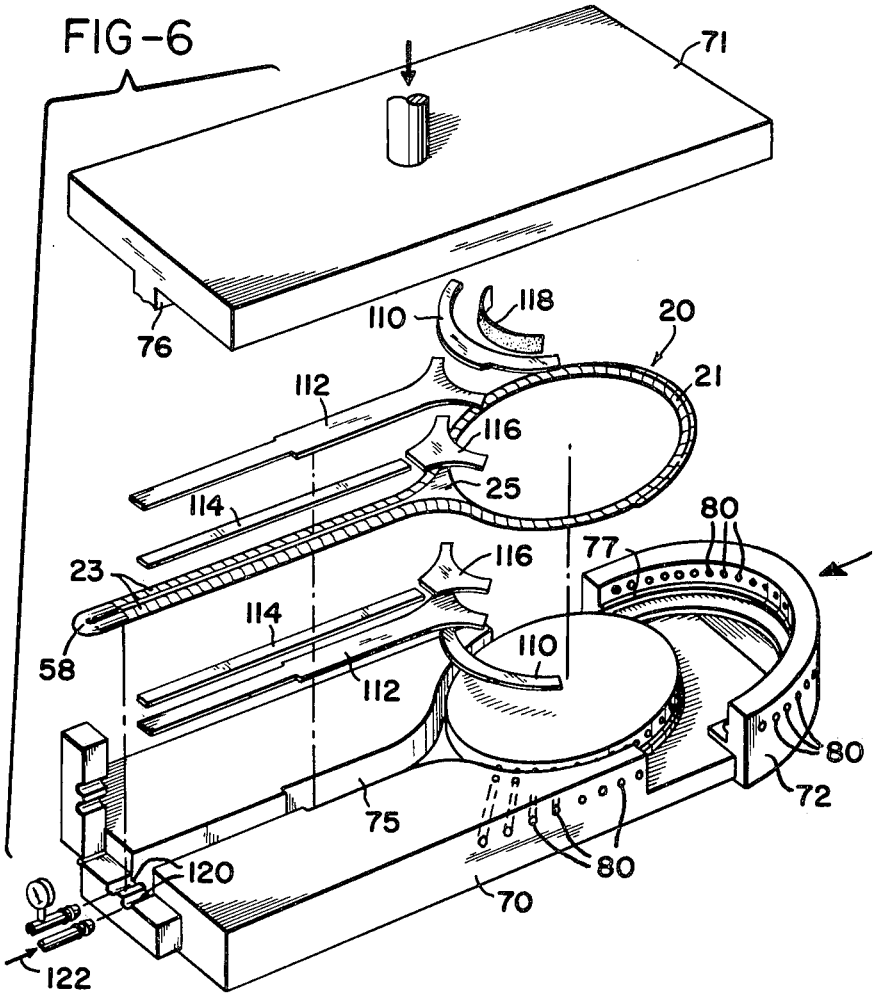
FIG. 6 is a cross sectional view of the mold and fixture for placing string holes in a straight mandrel in accordance with a first preferred method of the present invention.

The final assembly and molding operations of the first alternative method are illustrated in FIG. 6 as carried out in a mold comprising three main parts 70, 71 and 72. The mold part 70 includes the bottom and sides of the cavity 75 corresponding to the handle portion of the racket frame, the throat portion, the inside of the head portion, and that part of the outside of the head portion which does not contain the groove 16. The upper mold part 71 includes a male section 76 defining the upper wall of the cavity 75 in the part 70. The part 72 is movable horizontally toward and away from the parts 70–71 and includes a cavity defining the outside of the head portion of the frame and incorporating an internal rib 77 located and proportioned to form the groove 16.

Positioned at predetermined spaced locations in the mold parts 70 and 72 in the area defining the head and throat portions of the racket, are a plurality of holes 80 which extend completely through the sides of the mold, through the mold cavity and into the interior solid portion of the mold. These holes correspond to the positions of the string holes in the head and throat of the racket, and in the preferred embodiment, are of the same diameter.

Figure 9:
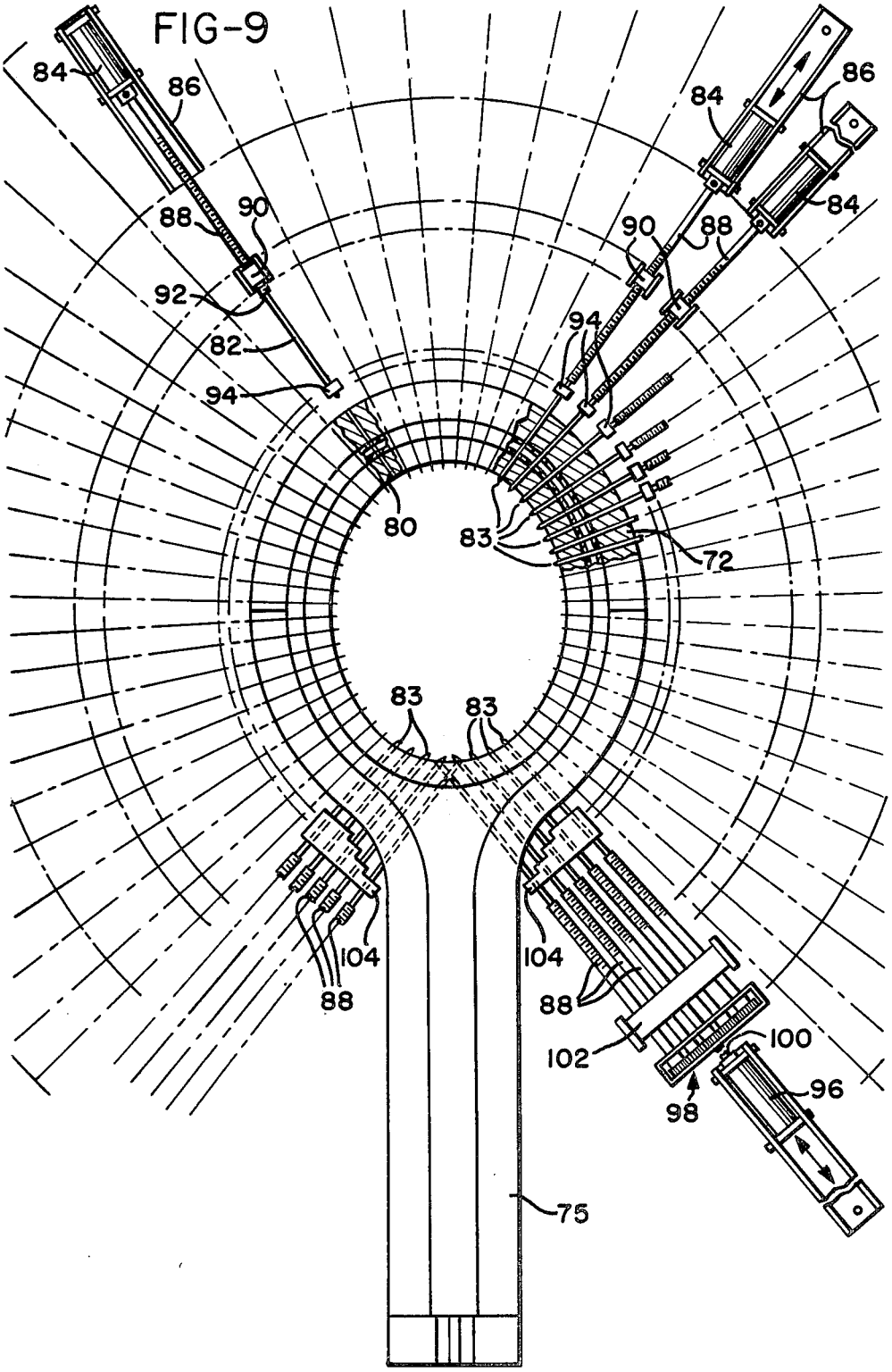
FIG. 9 is a top plan view illustrating the fixture for use in the first preferred variation of the method of the present invention with both a single-type and a gang-type penetrating tool drive arrangement for forming string holes in the curing mold.
Figure 12:
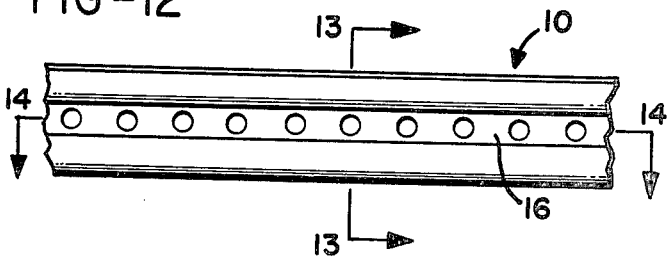
FIG. 12 is a view of a segment of the head portion of a racket frame with holes formed therein in accordance with the present invention.
Figure 13:
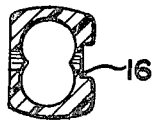
FIG. 13 is a cross sectional view along line 13—13 of FIG. 12.
Figure 14:
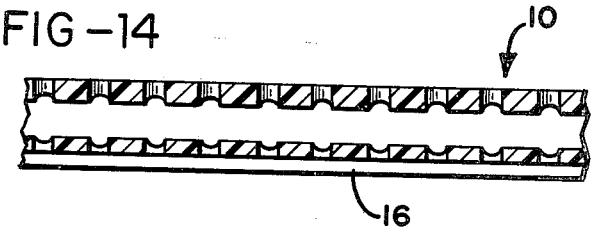
FIG. 14 is a cross sectional view along line 14—14 of FIG. 12.
Figure 10:
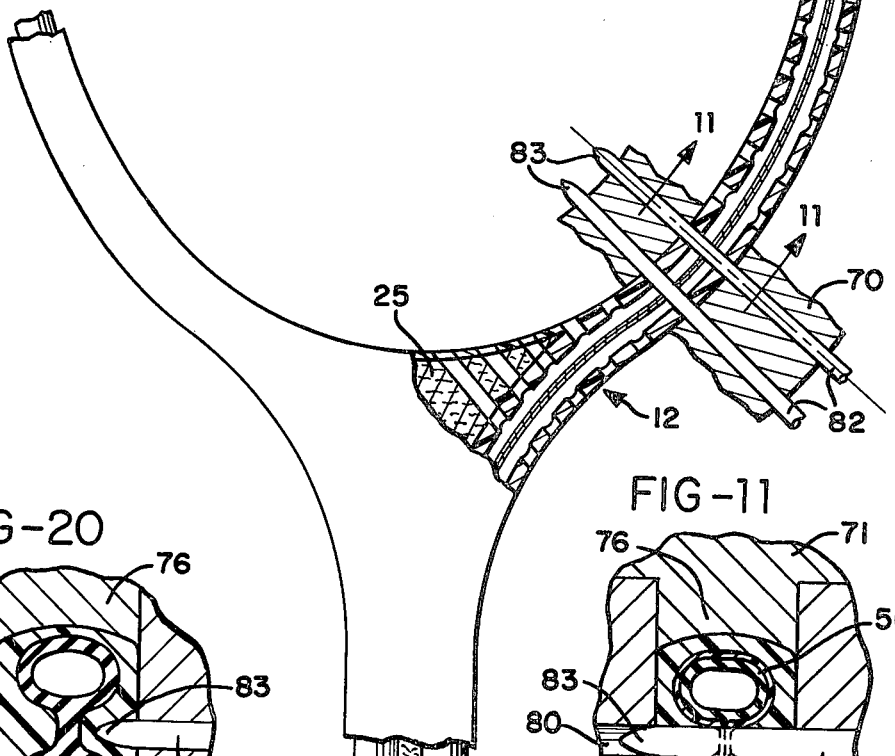
FIG. 10 is a plan view of a portion of a racket partially in cross section, illustrating the positioning of the penetrating tools as they extend through the racket frame in accordance with the first preferred variation of the method of the present invention.

When the mold is closed each of the holes 80 is aligned with a penetrating tool 82, as shown in FIG. 9. The penetrating tools preferably have a bullet-shaped penetrating tip 83, which shape has proved to be the most satisfactory in forcing the fibers in the fiber reenforced resin material apart without injuring them. The penetrating tools are made of stainless steel and are preferably coated with a release agent before being used to penetrate through the tubular member to form the holes therein, so that the tools may be easily withdrawn after the molding operation.

As shown in FIG. 9, each penetrating tool 82 is supported by a drive fixture mounted to the frame supporting the mold. Each drive fixture includes a reversible motor 84 which, for example, can be electric, hydraulic or air driven, and which is supported in a frame 86 for axial movement in line with the penetrating tool 82. Connecting the drive shaft of each motor to the corresponding penetrating tool 82 is a threaded rod 88 which passes through a stationary correspondingly threaded block 90. Rod 88 is secured to the penetrating tool 82, such as by welding at 92, or formed integrally therewith. A guide member 94 associated with each penetrating tool 82 is positioned adjacent the side of the mold and has a hole therein for supporting each of the penetrating tools 82 in alignment with a corresponding hole 80.

An alternative drive means for the penetrating tools 82 is also illustrated in FIG. 9 at the position for forming holes in the neck of the racket. In this arrangement, a plurality of penetrating tools 82 are driven simultaneously by a single motor 96 through a gear train 98. The gears 98 have the same diameter and are mutually engaged for being simultaneously driven off of the same main drive shaft 100 of motor 96. Each of the threaded rods 88 is supported in a correspondingly threaded hole in block 102, which holes are aligned with holes 80. Block 102 is secured relative to the mold so that as the rods 88 are rotated the penetrating tools 82 are advanced or retracted from the mold. The penetrating tools 82 are supported in guide block 104 which is also fixed relative to the mold and has a plurality of holes each corresponding to a hold 80 aligned with one of the plurality of penetrating tools 82 of the group driven by motor 96. This is essentially the same driven as that utilized where each of the penetrating tools 82 is driven by a separate motor, as discussed above, except that it reduces the number of motors required and thus can be advantageous cost savings.

In the final assembly steps before closing the mold and curing the tubular member 20, a crescent shaped strip 110 of binder-impregnated fiber is set in the bottom of that portion of the cavity in mold part 70 which underlies the filler piece 25 along the inner end of the head portion 10 and adjacent portions of the loop 21. A layer 112 of the fiber material of the same dimensions as the width of the handle and throat portions is then set in the bottom of the cavity. Then a strip 114 of about half the width as the handle portion of the frame is set in the cavity, along with a piece 116 matching the outline of the throat portion of the frame. Also a strip 118 is set along the side of the cavity opposite the throat portion so that it will overlie the exposed edge of the filler piece 25 in the finished frame.

The refrigerated tubular member 20 from the mold 60 is then set in the cavity 75, with the ends of the tube 56 and loop 58 extending to the outside through appropriate grooves 120 in the mold. The divider strip 26 can be inserted at that time if it was not inserted when the tubular member was placed in the preform mold 60. A second series of strips 110, 112, 114 and 116 is then laid on top of the tubular member 20, after which the mold parts 71 and 72 are moved into position to close the mold. A clamp 86 is then attached to loop 58 to close off air passage around the loop.

For efficient production, the mold parts 70–72 are maintained at the desired curing temperature, so that as soon as the mold is closed, the refrigerated binder begins to soften. When it is thoroughly softened, for example after two to three minutes, air pressure is applied to the projecting ends of the tube 56 as indicated at 122, at a sufficient pressure to expand the tubular member 20 into firm engagement with all surfaces of the mold cavity and thereby to maintain all the fiber layers in tension while the binder is setting and penetration of tools 82 is taking place, and also to cause the slack fiber material opposite the rib 77 to engage this rib evenly in order to form the groove 16. This pressure is not critical, and satisfactory results have been obtained with air at a pressure of 40 p.s.i. The temperature of the mold and the time of curing are interdependent, in accordance with standard practice for the curing of fiber reenforced plastics. However, the temperature should not exceed the level at which the tube 56 would disintegrate before the end of the initial stage of the curing cycle.

Figure 11:
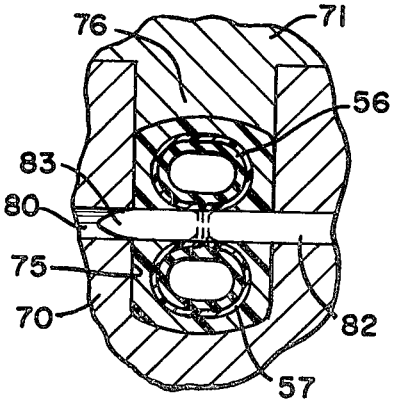
FIG. 11 is a cross sectional view through the mold of FIG. 6 with the penetrating tool inserted through the tubular member between the runs of tubing.

Immediately after the binder has softened the drive motors 94 and 86 are activated so that all of the penetrating tools 82 are simultaneously rotated and driven through the mold so as to penetrate completely through both sides of the tubular member 20 through the space between the upper and lower runs of tube 56 in the heat sealed portion 59 of the sleeve 57, as seen in FIG. 11. The penetrating tools 82 remain in this position until the frame has cured. The tools are then retracted by motors 84 and 96, the mold is opened, air pressure is relieved from the tube 56, and the molded frame is then ejected. The tube 56 is then withdrawn and any flash or surplus material can then be removed, after which the cure should be completed, satisfactory results having been obtained in an oven at a temperature of 250° F. For a period of three hours.

In the finished form the head portion of the racket will have a cross section such as shown in FIG. 11 in which the central cavity will have the appearance of a figure-eight formed by the tube 56, with the string holes formed through the center thereof.

Figures 15, 16, 17, 18, 19:
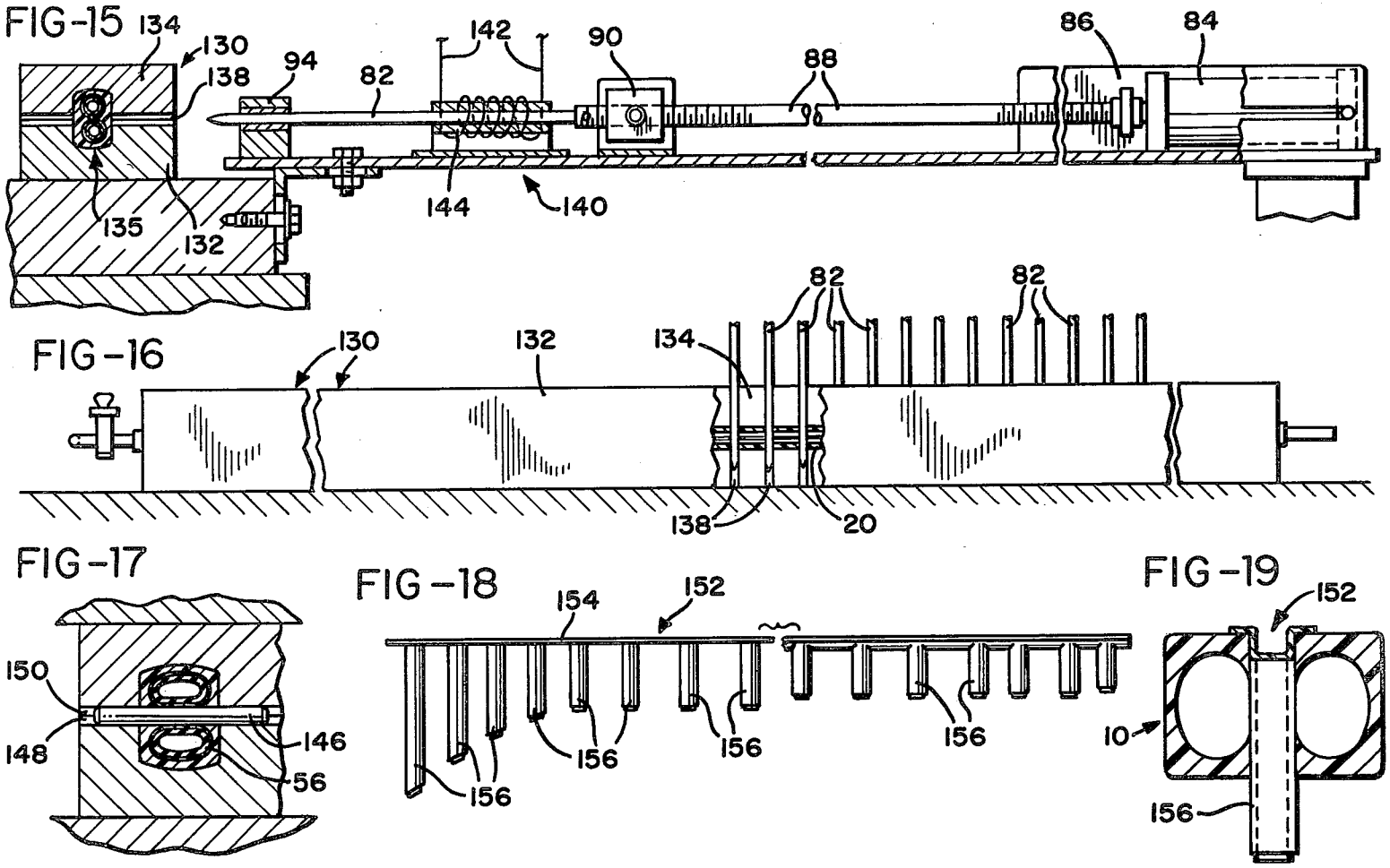
FIG. 15 is a cross sectional view of the mold and fixture for placing string holes in a straight tubular member in accordance with a second preferred variation of the method of the present invention.
FIG. 16 is a plan view of the mold of FIG. 15 partially in cross section illustrating the penetrating tools extending through the tubular member contained within the mold.
FIG. 17 is a cross sectional view through FIG. 16 with the penetrating tool removed and a pin inserted through the string hole formed in the tubular member.
FIG. 18 is a pictorial illustration of a grommet strip which can be placed in the holes in the straight tubular member after the holes have been formed and prior to being positioned in the curing mold.
FIG. 19 is a cross sectional view through the head portion of the frame of a racket with one grommet of the grommet strip of FIG. 18 positioned in a corresponding hole prior to insertion in the curing mold.

Referring now to the second alternative preferred method of the present invention with particular references to FIGS. 15 through 19, after the tubular member 20 is first formed and the tube 56 and sheath 57 are positioned in the central hollow core thereof, the tubular member is placed in a mold 130 which maintains the tubular member in a straight line as shown in a top view of the mold in FIG. 16. Mold 130 is formed of a base portion 132 and a top portion 134 which together form a cavity 135 along the length of the mold such that with the tubular member 20 positioned in the mold they will have a cross sectional appearance as shown in FIG. 15. The shape of the mold 130, however, is not as critical since the racket is not being formed from the tubular member 20 at this point in the process. The only shape restriction is that the mold will shape the tubular member 20 for proper positioning of the string holes when the tubular member is later placed in the curing mold to form the finished racket.

Along the central portion of the mold 130 a plurality of spaced holes 138 are formed therethrough which correspond to the string hole positions on the finished racket. The holes are split by the part line of the mold for reasons discussed below. A plurality of penetrating tools 82 associated with the holes 138 are positioned on a fixture table 140 in alignment with the holes in the mold and are driven through the holes with the same mechanism utilized in conjunction with the first preferred variation of the method of the present invention, discussed above.

One distinction, however, over the drive mechanism described in the first preferred variation of the method of the present invention is that in this second method a heating coil 142 is wrapped about a sleeve 144 supported on penetrating tool 82, which can heat the penetrating tool along its length in order to provide the temperature increase in the tubular member 20 necessary to soften the material in order to permit the penetrating tool 82 to separate the fibers in the resinous layers and pass through the tubular member. Thus, only that portion of the tubular member 20 in the area of each of the string holes is softened as a result of contact with the heated penetrating tools in order to permit them to pass therethrough. The remainder of the tubular member is not softened and remains in its semi-hard condition. After the penetrating tools have passed completely through the tubular member 20 they are removed by reversing drive motors 84.

In order to properly align the holes in the mold and maintain their formation during curing of the racket in the curing mold of the type disclosed in the above referred application Ser. No. 827,670, a series of pins 146 are inserted in the holes in the racket head through the holes in the mold. Pins 146 are of the same diameter as the string holes and are longer than the width of tubular member 20 so that they extend therethrough as shown in FIG. 17. After pins 146 are inserted in each of the string holes, pressure is relieved in the tubing, the mold is opened and the tubular member with the pins 146 in position is removed from the mold.

The tubular member is then positioned in the curing mold which has a plurality of semi-circular recesses 148 and 150 in the bottom and top portions, respectively, of the mold which together form an opening corresponding to the diameter of pins 146 and which are positioned in proper locations and orientations around the head of the mold in order to maintain the holes formed in the racket head in their location during curing. As can be seen by FIG. 17, the mold in this case must be formed with a part line through the center of the recesses 148 and 150 in order to permit the pins 146 to be inserted in the mold, as is the case with the mold 130. After the tubular member has been inserted in the mold and the mold closed the runs of the tube 56 are again inflated with proper pressure to maintain the form of the racket during the curing operation.

After curing in the mold is completed, the pressure in the tube 56 is relieved, the mold opened and the racket frame removed. The pins 146 are then removed from the string holes formed in the racket and tube 56 and sheathing 57 are removed from the interior of the racket. The racket is then finished in the manner described above.

In place of the pins 146 utilized in connection with this second preferred variation of the method of the present invention, a further variation thereof includes the use of a grommet strip 152 as shown in FIG. 18. The grommet strip 152 is formed of a continuous backing member 154 of relatively thin rectangular cross section, integrally with which is formed a plurality of grommet tubes 156 which are spaced at appropriate intervals for positions of the strings in the head and throat portions of the racket when the strip is curved to conform to the racket. The holes in the grommet tubes 156 extend through the strip 154 since the strip will remain in the racket head after it has been formed in the curing process. The tubular grommets 156 are slightly longer than the intended final length of the grommets in the finished racket. The additional length is utilized to position the grommet strip, and the tubular member in which it is inserted, properly in the curing mold. A plurality of recesses similar to the recesses 148 and 150 are formed in the internal regions of the mold to receive the outer ends of the tubular grommets 156 in order to maintain them in proper alignment during the curing operation. After the racket has been molded and cured as described above, the racket with the now integrally formed grommet strip 152 is removed and the additional length of the grommets 156 is removed. The racket is then finished in the manner mentioned above.

Although the foregoing illustrates the preferred method of the present invention, other variations are possible. All such variations as would be obvious to one skilled in this art are intended to be included within the scope of the invention as defined by the following claims.

What is claimed is:

1. A method of making a racket frame having a handle portion, a throat portion and a head portion, and for forming holes for positioning strings in at least said head portion of said racket, comprising the steps of:

forming a hollow-core flexible tubular member including plurality of fiber reinforced heat-curable resin-impregnated layers;

placing a pressurizable tube in said hollow-core of said tubular member, said tube providing a central region through which a hole forming penetrating means can pass without puncturing said pressurizable tube and extending along at least a portion of its length in an area of said tubular member where string holes are to be formed;

positioning said tubular member with said tube therein in a mold cavity for containing said tubular member in a predetermined transverse cross sectional shape having holes therethrough in positions for forming string holes in at least said head portion of said racket;

pressurizing said tube sufficiently to maintain said tubular member in conformity with said mold cavity;

heating said tubular member in at least the areas where said string holes are to be formed to soften said resin sufficiently to be penetrated by said hole forming penetrating means then;

passing said hole forming penetrating means completely through said holes in said mold cavity and through said tubular member in said central region of said tube to form said string holes in said tubular member; and then curing said tubular member in the shape of a racket to form said frame with said string holes therein.

2. A method of making a racket frame as defined in claim 1 wherein said step of placing a pressurizable tube in said hollow core of said tubular member includes:

utilizing a tube of sufficiently small diameter that it can be looped so as to have two parallel runs of tubing extending through said hollow core wherein said central region is provided by the space between said two parallel runs.

3. A method of making a racket frame as defined in claim 2, including the steps of:

positioning said parallel runs of tube in a sheath;

heat sealing a central region of said sheath between said parallel runs so as to provide a separation between said parallel runs of tubing in said central region thereof;

positioning said tubing in said sheath inside said hollow core of said tubular member.

4. A method of making a racket frame as defined in claim 1, 2 or 3 wherein said step of positioning said tubular member in a mold cavity includes:

said mold cavity holding said tubular member in substantially the final shape of a racket frame to be formed.

5. A method of making a racket frame as defined in claim 4, wherein said step of heating said tubular member includes:

heating said mold cavity sufficiently to heat said tubular member to soften said resin and subsequently to cure said tubular member to form said racket frame with the string holes formed therein.

6. A method of making a racket frame as defined in claim 5, wherein said step of passing a plurality of penetrating means through said mold cavity includes:

passing a plurality of penetrating tools through said holes in said cavity so as to penetrate through said tubular member without severing said fibers in said reinforced resin-impregnated layers;

allowing said penetrating tools to remain in said mold cavity and extending through said tubular member during said curing of said tubular member;

extracting said plurality of penetrating tools from said tubular member after curing thereof;

relieving said pressure in said tube;

removing said racket frame from said mold cavity; and removing said tubular member from said hollow core frame.

7. A method of making a racket frame as defined in claim 1, 2 or 3 wherein said step of positioning said tubular member in a mold cavity includes:

said mold cavity holding said tubular member in a straight line.

8. A method of making a racket frame as defined in claim 7, including the step of:

heating said penetrating means sufficiently to heat said resin in the area where each hole is to be formed during penetration of the penetrating means therethrough.

9. A method of making a racket frame as defined in claim 8, including the steps of:

passing a plurality of heated penetrating means through said tubular member to form said string holes;

removing said penetrating means from said tubular member;

inserting pin means in each string hole;

removing said tubular member from said mold cavity;

placing said tubular member in a further mold cavity for holding said tubular member in the shape of a racket;

curing said tubular member in said further mold cavity to form said frame;

removing said frame from said further mold cavity; and removing said tube from said frame.

* * * * *

UNITED STATES PATENT AND TRADEMARK OFFICE

CERTIFICATE OF CORRECTION

PATENT NO. : 4,264,389
DATED : April 28, 1981
INVENTOR(S) : Anthony F. Staub et al It is certified that error appears in the above-identified patent and that said Letters Patent are hereby corrected as shown below:

Column 6, line 22, "3/8" should be --5/8--.

Column 7, line 8, "efficiency" should be --deficiency--.

Column 7, line 35, "underlayer" should be --under layer--.

Column 12, line 10, before "plurality", insert --a--.

Signed and Sealed this

*Twenty-eighth* Day of *July 1981*

[SEAL]

*Attest:*

GERALD J. MOSSINGHOFF

*Attesting Officer*

*Commissioner of Patents and Trademarks*